US010553385B2

(12) United States Patent
Nakanishi et al.

(10) Patent No.: US 10,553,385 B2
(45) Date of Patent: Feb. 4, 2020

(54) CHIP FUSE AND METHOD FOR PRODUCING SAME

(71) Applicant: KAMAYA ELECTRIC CO., LTD., Kanagawa (JP)

(72) Inventors: Koji Nakanishi, Hokkaido (JP); Satoshi Nishimura, Hokkaido (JP)

(73) Assignee: Kamaya Electric Co., Ltd., Kanagawa (JP)

( * ) Notice: Subject to any disclaimer, the term of this patent is extended or adjusted under 35 U.S.C. 154(b) by 0 days.

(21) Appl. No.: 15/311,238

(22) PCT Filed: Apr. 28, 2015

(86) PCT No.: PCT/JP2015/062793
§ 371 (c)(1),
(2) Date: Nov. 15, 2016

(87) PCT Pub. No.: WO2015/174270
PCT Pub. Date: Nov. 19, 2015

(65) Prior Publication Data

US 2017/0084415 A1 Mar. 23, 2017

(30) Foreign Application Priority Data

May 16, 2014 (JP) ..... 2014-102171

(51) Int. Cl.
*H01H 85/17* (2006.01)
*H01H 85/041* (2006.01)
(Continued)

(52) U.S. Cl.
CPC ..... *H01H 85/17* (2013.01); *H01H 85/041* (2013.01); *H01H 85/08* (2013.01);
(Continued)

(58) Field of Classification Search
CPC ..... H01H 69/02; H01H 85/17; H01H 85/175; H01H 85/1755; H01H 85/43;
(Continued)

(56) References Cited

U.S. PATENT DOCUMENTS 4,599,596 A * 7/1986 Arikawa ..... H01H 85/0411 337/201
2004/0104801 A1* 6/2004 Jollenbeck ..... H01H 85/0418 337/159
(Continued)

FOREIGN PATENT DOCUMENTS

JP S61-158060 U 9/1986
JP 2012-174443 A 9/2012

*Primary Examiner* — Jacob R Crum
(74) *Attorney, Agent, or Firm* — Jason D. Voight

(57) ABSTRACT

Provided is a chip fuse and a method for producing the same, which is improved to facilitate balanced release of impact and vapor generated upon fusion. The chip fuse includes a fuse body having a pair of facing upper and lower ceramic substrates, a fuse wire support having a vertical through hole in its center and held between the ceramic substrates, and a fuse wire mounted between the two ends of the fuse wire support across the through hole, and a pair of metal caps fitted on the two ends of the fuse body, wherein the upper ceramic substrate and the fuse wire support, and the lower ceramic substrate and the fuse wire support, are respectively adhered together on their mutually facing surfaces to hermetically close the through hole, partially leaving a non-adhered region on the adhered surfaces.

12 Claims, 15 Drawing Sheets

(51) Int. Cl.
*H01H 85/08* (2006.01)
*H01H 69/02* (2006.01)
*H01H 85/157* (2006.01)

(52) U.S. Cl.
CPC ..... *H01H 69/02* (2013.01); *H01H 85/157* (2013.01); *H01H 2085/0414* (2013.01)

(58) Field of Classification Search
CPC ..... H01H 2085/0414; H01H 85/041; H01H 85/08; H01H 85/157; H01H 2085/0412
USPC ..... 337/290
See application file for complete search history.

(56) References Cited

U.S. PATENT DOCUMENTS

2005/0035841 A1* 2/2005 Kobayashi ..... B23K 35/262 337/157
2005/0057337 A1* 3/2005 Richter ..... H01H 85/0418 337/187
2005/0141164 A1 6/2005 Bender et al.
2013/0106564 A1* 5/2013 Salonga ..... H01H 85/003 337/205
2014/0266564 A1* 9/2014 Enriquez ..... H01H 85/08 337/295

* cited by examiner

CHIP FUSE AND METHOD FOR PRODUCING SAME

This is the national stage of International Application PCT/JP2015/062793, filed Apr. 28, 2015.

FIELD OF ART

The present invention relates to a small chip fuse, in particular a chip fuse having a fuse wire placed through its body and used in units supplying power equivalent to rated current and voltage for general household, as well as a method for producing the chip fuse.

BACKGROUND ART

In a protection circuit on the primary side of a transformer used with a power unit, a fuse (primary fuse), generally a tubular fuse installed in a fuse holder, is used. To cope with the demand of the market for downsizing and weight-saving of a power unit, however, fuses have come to be directly surface-mounted on a wiring board. For this purpose, rather than a tubular fuse having a cylindrical glass casing, a rectangular chip fuse is often used, in which a linear or strip-shaped fuse element is mounted between the electrodes in a box-shaped ceramic casing. An example of prior art of such a box-shaped casing is disclosed in JP-2012-174443-A, known from which is a chip fuse composed of a fuse wire support made of ceramics and having a through hole along its center, a fuse wire mounted linearly across the through hole between the two opposed ends of the fuse wire support, a cylindrical ceramic casing in which the fuse wire support with the fuse wire as a fuse assembly is inserted, and metal caps located at both ends of the cylindrical body of the casing in electrical conduction with the fuse wire projecting from both ends of the fuse wire support.

Patent Publication 1: JP-2012-174443-A

SUMMARY OF THE INVENTION

Problems to be Solved by the Invention

The conventional chip fuse as discussed above is structured by inserting, into the cylindrical ceramic casing, the fuse assembly consisting of the fuse wire and the fuse wire support, so that the impact from current interruption by the fuse cannot be released to anywhere, causing possible damaging or deformation of the casing. Further, an evaporation product of the fuse element (vapor) generated upon fusion cannot be released to anywhere, and the vapor remains in the casing after fusion, which disadvantageously disturbs security of the insulating resistance between the fused fuse terminals or between the fused fuse wire ends.

The present invention has been made to solve the conventional drawbacks. It is therefore an object of the present invention to provide a chip fuse which is improved to facilitate balanced release of the impact and the vapor generated upon fusion, as well as a method for producing the chip fuse.

Means for Solving the Problem

According to the present invention, there is provided, as a solution to the above problems, a chip fuse comprising a fuse body and a pair of metal caps, said fuse body further comprising:

a pair of vertically facing upper and lower ceramic substrates, a fuse wire support having a vertical through hole in its center and held between said upper and lower ceramic substrates, and a fuse wire mounted between two ends of said fuse wire support across the through hole, wherein said metal caps are fitted on two ends of said fuse body in electrical conduction with said fuse wire extending out of two ends of said fuse wire support, wherein said upper ceramic substrate and said fuse wire support, and said lower ceramic substrate and said fuse wire support, are respectively adhered together on their mutually facing surfaces to hermetically close said through hole, partially leaving a non-adhered region on said surfaces adhered.

According to an embodiment of the invention, the non-adhered region may be formed on both sides of the through hole with respect to its longitudinal.

The fuse wire support may be composed of an upper fuse wire support half and a lower fuse wire support half vertically arranged with respect to each other, the through hole may vertically penetrate the upper fuse wire support half and the lower fuse wire support half, and the fuse wire may be mounted across the through hole in the longitudinal direction of the fuse wire support. The non-adhered region may be formed between the upper ceramic substrate and the upper fuse wire support half, between the upper fuse wire support half and the lower fuse wire support half, and between the lower fuse wire support half and the lower ceramic substrate.

According to another embodiment, the fuse wire support may be a single body, and the fuse wire may be mounted across the through hole in the fuse wire support at a slant between two opposed ends of the fuse wire support from an upper surface at one of the ends to a lower surface at the other of the ends of the fuse wire support.

According to the present invention, there is also provided a method for producing the above-mentioned chip fuse, comprising:

mounting a fuse wire between two ends of a fuse wire support having a vertical through hole in its center, across said through hole, holding said fuse wire support with the fuse wire between a pair of vertically facing ceramic substrates, adhering together said pair of the ceramic substrates and said fuse wire support on their mutually facing surfaces, partially leaving a non-adhered region on said surfaces adhered, to thereby form a fuse body, and fitting a metal cap on each end of said fuse body in electrical conduction with said fuse wire.

According to an embodiment of the invention, the non-adhered region may be formed on both sides of the through hole with respect to its longitudinal.

The fuse wire support may be composed of an upper fuse wire support half and a lower fuse wire support half vertically arranged with respect to each other, the through hole may vertically penetrate the upper fuse wire support half and the lower fuse wire support half, and the fuse wire may be mounted across the through hole in the longitudinal direction of the fuse wire support between the upper fuse wire support half and the lower fuse wire support half. The non-adhered region may be formed between the upper ceramic substrate and the upper fuse wire support half, between the upper fuse wire support half and the lower fuse wire support half, and between the lower fuse wire support half and the lower ceramic substrate.

According to another embodiment, the fuse wire support may be a single body, and the fuse wire may be mounted across the through hole in the fuse wire support at a slant between two opposed ends of the fuse wire support from an upper surface at one of the ends to a lower surface at the other of the ends of the fuse wire support.

According to the present invention, there is further provided a method for producing the above-mentioned chip fuse, comprising:

adhering together an upper ceramic substrate and an upper fuse wire support half having a vertical through hole in its center, and a lower ceramic substrate and a lower fuse wire support half having a vertical through hole in its center, respectively, on their mutually facing surfaces, partially leaving a non-adhered region in said surfaces respectively adhered, mounting a fuse wire between two ends of said lower fuse wire support half across said through hole, arranging vertically with respect to each other and adhering together said lower fuse wire support half with the fuse wire and said upper fuse wire support half on their mutually facing surfaces, partially leaving a non-adhered region on said surfaces adhered, to thereby form a fuse body, and fitting a metal cap on each end of said fuse body in electrical conduction with said fuse wire.

According to an embodiment, the non-adhered region may be formed on both sides of the through hole with respect to its longitudinal.

Effects of the Invention

The chip fuse according to the present invention is mainly composed of a fuse body including a pair of vertically facing upper and lower ceramic substrates, a fuse wire support, and a fuse wire mounted on the fuse wire support, and the upper ceramic substrate and the fuse wire support, and the lower ceramic substrate and the fuse wire support, are respectively adhered together on their mutually facing surfaces to hermetically close the through hole, partially leaving a non-adhered region on the adhered surfaces, so that the impact and the vapor generated upon fusion of the fuse is released from inside the chip fuse through the non-adhered regions to outside. Thus, deformation and damage of the chip fuse may be avoided. Since the vapor is not retained inside the chip fuse, the insulating resistance between the fused fuse terminals or between the fused fuse wire ends may be secured, which improves the performance of the chip fuse.

The present invention realizes a fuse which is not damaged upon fusion and in which the insulating resistance between the fused fuse terminals or between the fused fuse wire ends is secured, and protects elements of electronic circuits used in a distribution board or the like which undergoes relatively high voltage and current for general household or the like, to secure the safety against fire disasters.

EMBODIMENTS OF THE INVENTION

Figure 1:
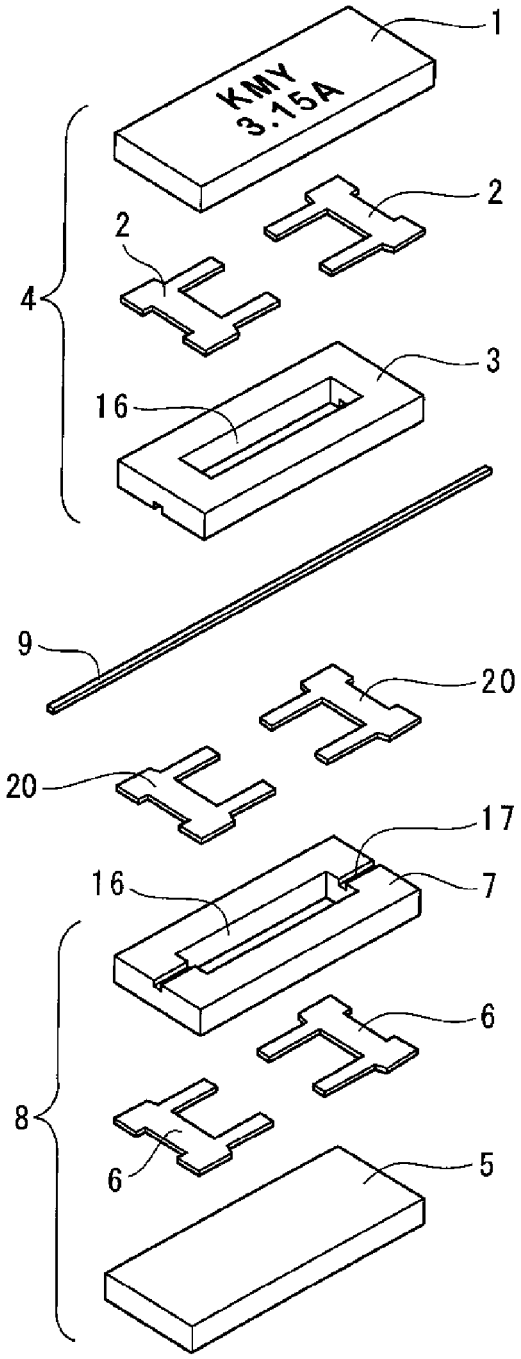
FIG. 1 is an exploded perspective view of the fuse body of the chip fuse according to a first embodiment of the present invention.

FIG. 1 is a perspective view of the body of a chip fuse (referred to as a fuse body), shown exploded, according to a first embodiment of the present invention. The fuse body is of a four-layer structure including upper ceramic substrate 1 arranged at the top, upper fuse wire support half 3 adhered with adhesive 2 to the lower surface of the upper ceramic substrate 1, lower ceramic substrate 5 arranged at the bottom of the fuse body, and lower fuse wire support half 7 adhered with adhesive 6 to the upper surface of the lower ceramic substrate 5. The upper fuse wire support half 3 and the lower fuse wire support half 7 are later adhered to each other with adhesives 20 to form a single fuse wire support. The upper ceramic substrate 1 and the upper fuse wire support half 3 adhered together with the adhesives 2 form upper fuse support half 4, whereas the lower ceramic substrate 5 and the lower fuse wire support half 7 adhered together with the adhesives 6 form lower fuse support half 8. Between the upper fuse support half 4 and the lower fuse support half 8, i.e., between the upper fuse wire support half 3 and the lower fuse wire support half 7, is held fuse wire 9.

Figure 2:
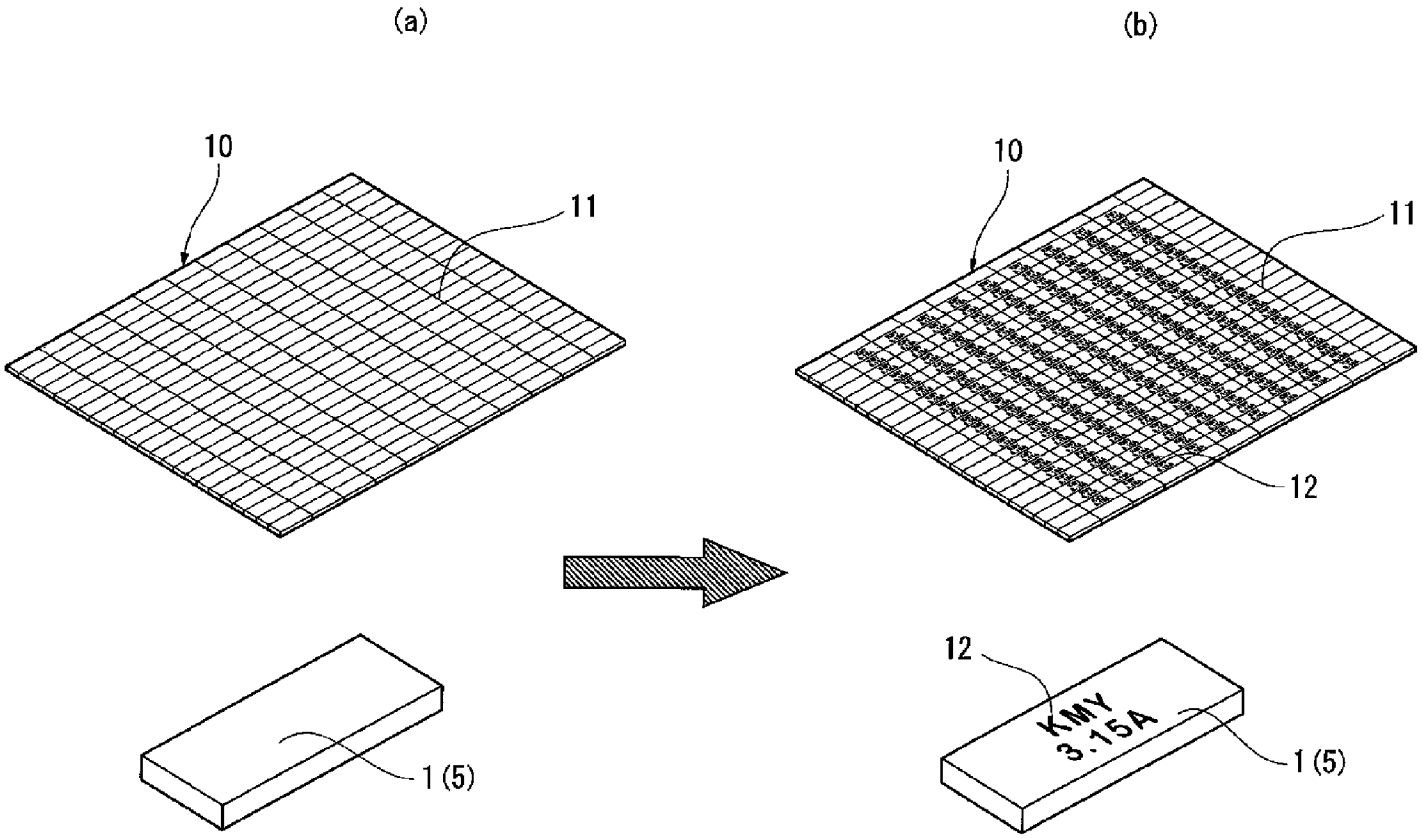
FIG. 2 is a schematic perspective view illustrating the process of cutting of the ceramic substrates out of a material sheet in the production process of the first embodiment.

The upper ceramic substrate 1 and the lower ceramic substrate 5 are in the form of a thin flat plate, and cut out of a ceramic sheet having a larger area than that of the ceramic substrate 1, 5. FIG. 2 is a perspective view illustrating the process of cutting of the ceramic substrates 1, 5 out of a material ceramic sheet 10. FIG. 2(*a*) shows the sheet 10 having slits 11 formed thereon. Each section defined by the slits 11 is equivalent to the size of a single ceramic substrate 1, 5. The sheet 10 with the slits 11 is subjected to works, such as marking of each section, to provide marks 12 or the like shown in FIG. 2(*b*). The sheet 10 that has undergone such processing is split along the slits 11 to obtain the ceramic substrates 1, 5.

Figure 3:
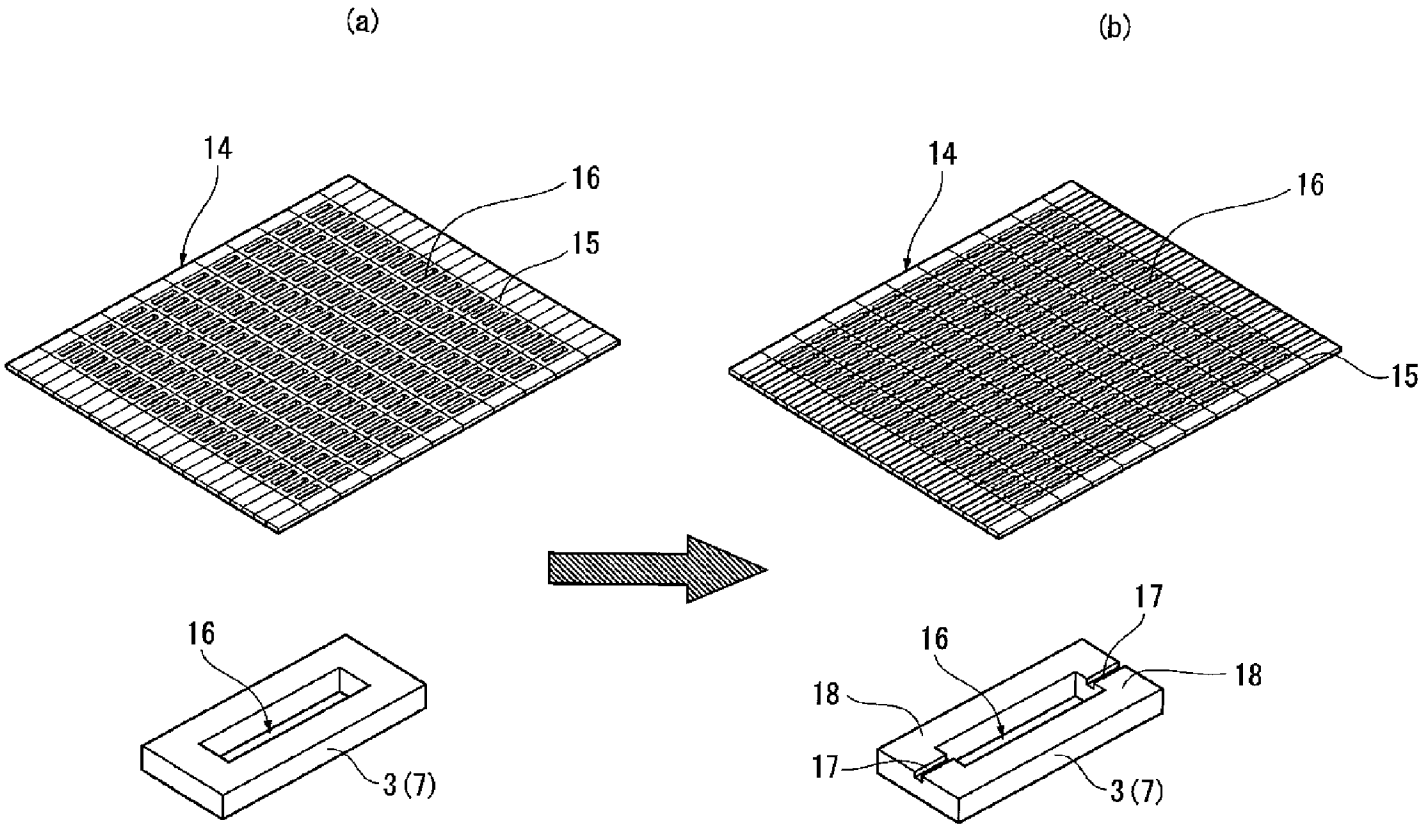
FIG. 3 is a schematic perspective view illustrating the process of cutting of the fuse wire support halves out of a material sheet in the production process of the embodiment.

The upper fuse wire support half 3 and the lower fuse wire support half 7 are in the form of a thin flat plate, and cut out of a sheet, e.g. an alumina ceramics sheet, having a larger area than that of the fuse wire support half 3, 7. FIG. 3 is a perspective view illustrating the process of cutting the fuse wire support halves 3, 7 out of a material sheet 14. FIG. 3(*a*) shows the sheet 14 having slits 15 formed thereon. Each section defined by the slits is equivalent to the size of a single fuse wire support half 3, 7. The sheet 14 with the slits 15 is subjected to works, such as press working, to provide through hole 16 in each section. Each section having the through hole 16 is further subjected to processing operation to form, by dicing, fuse wire support groove 17 at each longitudinal end of each through hole 16, as shown in FIG. 3(*b*). The sheet 14 that has undergone such processing is split along the slits 15 to obtain the fuse wire support halves 3, 7. The fuse wire support grooves 17 are formed in the upper fuse wire support half 3 in its lower surface across transverse end areas 18, and in the lower fuse wire support half 7 in its upper surface across transverse end areas 18.

The fuse wire 9 is made of a metal material in the form of wire or a thin rod, and produced by, for example, silver-plating annealed copper wire or iron-nickel alloy wire. The fuse wire 9 has been set at a particular fusing current value so as to fuse at the particular current value when connected in a circuit of electric equipment or facilities.

The adhesive 2, 6 used in adhering the ceramic substrate 1, 5 and he fuse wire support half 3, 7, respectively, may be, for example, an epoxy adhesive. The adhesive 2, 6 is formed into, for example, as shown in FIG. 1, a pair of rectangular U-shaped thin plates or thin films in accordance with the shape of the upper surface of the upper fuse wire support half 3 having the through hole 16. The length of a pair of arms of the rectangular U-shape is such that, when a pair of the rectangular U-shaped adhesives are arranged on the upper surface of the upper fuse wire support half 3 at both ends, with the openings of the rectangular U-shapes facing to each other, the length of the arms of the pair of the rectangular U-shaped adhesives is shorter than the longitudinal size of the upper surface. With such a configuration, when the upper ceramic substrate 1 is arranged and adhered on the upper fuse wire support half 3, non-adhered regions 26 are left on the adhered surfaces between the tips of the opposed arms of the pair of the facing rectangular U-shaped adhesives 2. Similarly, when a pair of the rectangular U-shaped adhesives 6 are arranged on the lower surface of the lower fuse wire support half 7 at both ends, with the openings of the rectangular U-shapes facing to each other, and the lower ceramic substrate 5 is arranged and adhered under the lower fuse wire support half 7, non-adhered regions 28 are left on the adhered surfaces. Though the adhesive 2, 6 is formed into a rectangular U-shape in this embodiment, the shape and the size of the adhesive 2, 6 may be changed over a wide variety. Accordingly, depending on the selection of the shape and size of the adhesive, one or three of the non-adhered region may be formed.

Figure 4:
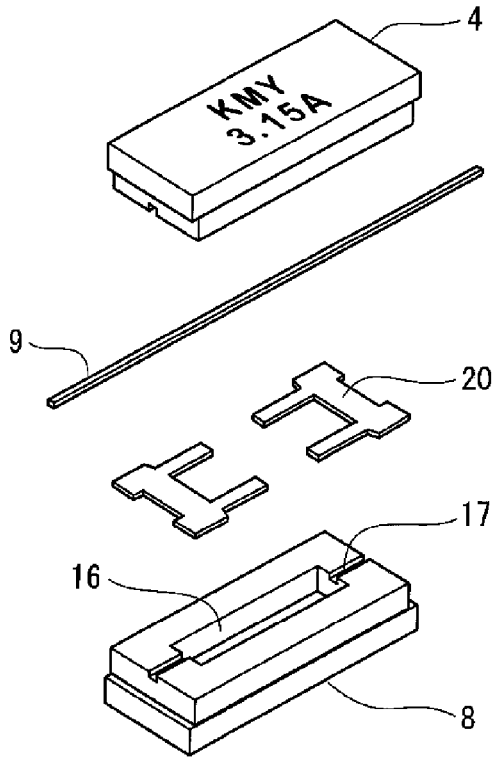
FIG. 4 is an exploded perspective view showing the upper fuse support half and the lower fuse support half arranged vertically facing to each other, with the fuse wire and the adhesive interposed therebetween, in the production process of the embodiment.
Figure 5:
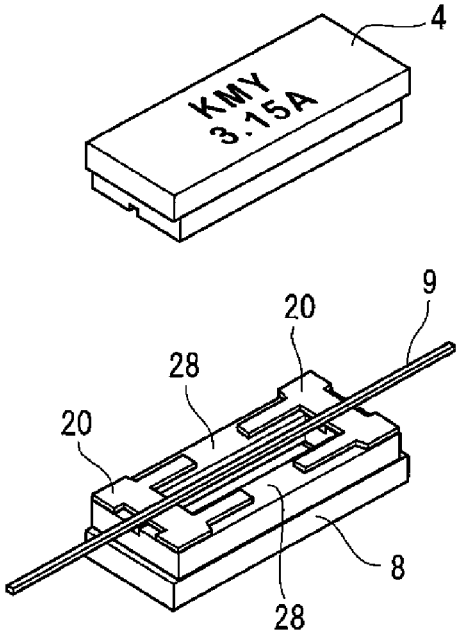
FIG. 5 is a perspective view showing the lower fuse support half having the adhesive and the fuse wire mounted thereon, in the production process of the embodiment.

FIG. 4 is a perspective view showing the upper fuse support half 4 obtained by adhering together the upper ceramic substrate 1 and the upper fuse wire support half 3 with the adhesive 2, and the lower fuse support half 8 obtained by adhering together the lower ceramic substrate 5 and the lower fuse wire support half 7 with the adhesives 6, arranged vertically facing to each other, with the fuse wire 9 and the pair of rectangular U-shaped adhesives 20 interposed between the fuse support halves 4 and 8. The adhesives 20 are similar to the adhesives 2, 6 discussed above. From the state shown in FIG. 4, a pair of adhesives 20 are arranged, with the openings of the rectangular U-shapes facing to each other, on the two end areas of, and on the fuse wire support grooves 17 of the upper surface of the lower fuse wire support half 7 of the lower fuse support half 8 and, before the adhesives 20 are cured, the fuse wire 9 is mounted between the fuse wire support grooves 17, with the two ends of the fuse wire 9 extending outwards from the fuse wire support grooves 17. This state is shown in FIG. 5. Also before the adhesives 2 are cured, the upper fuse support half 4 of the same shape is placed and adhered onto the lower fuse support half 8 having the fuse wire 9 mounted thereon, to thereby form intermediate part 21 for a fuse body according to this embodiment. Here, similarly to the above, non-adhered regions 27 are left on the adhered surfaces between the upper fuse wire support half 3 of the upper fuse support half 4 and the fuse wire support half 7 of the lower fuse support half 8. Meanwhile, by adhering together the upper fuse wire support half 3 and the lower fuse wire support half 7, the fuse wire support having the fuse wire 9 is formed.

In this way, the non-adhered region 26, 28, 27 is formed between the members 1 and 3, between the members 7 and 5, and members 3 and 7, respectively, on the adhered surfaces on both sides of the through hole 26 with respect to its longitudinal, while each pair of the members adhered together are closely adhered as a whole, so that the through holes 16 of the fuse wire support halves 3 and 7 define an internal space and is kept hermetically closed in the normal state, i.e., before fusion.

Figure 6:
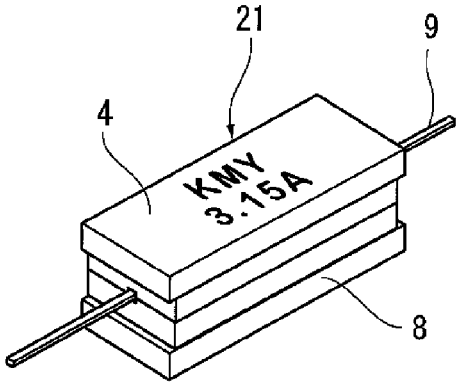
FIG. 6 is a perspective view showing the lower fuse support half and the upper fuse support half arranged and adhered thereon, in the production process of the embodiment.

FIG. 6 shows the intermediate part 21. In the state of the intermediate part 21 as shown in the figure, the ends of the fuse wire 9 are projecting from the end faces. These projecting portions are cut and removed, to obtain fuse body 22 as shown in FIG. 7.

Figure 7:
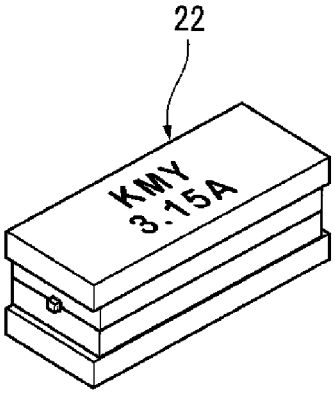
FIG. 7 is a perspective view of the fuse body fabricated through the steps shown in up to FIG. 6.
Figure 8:
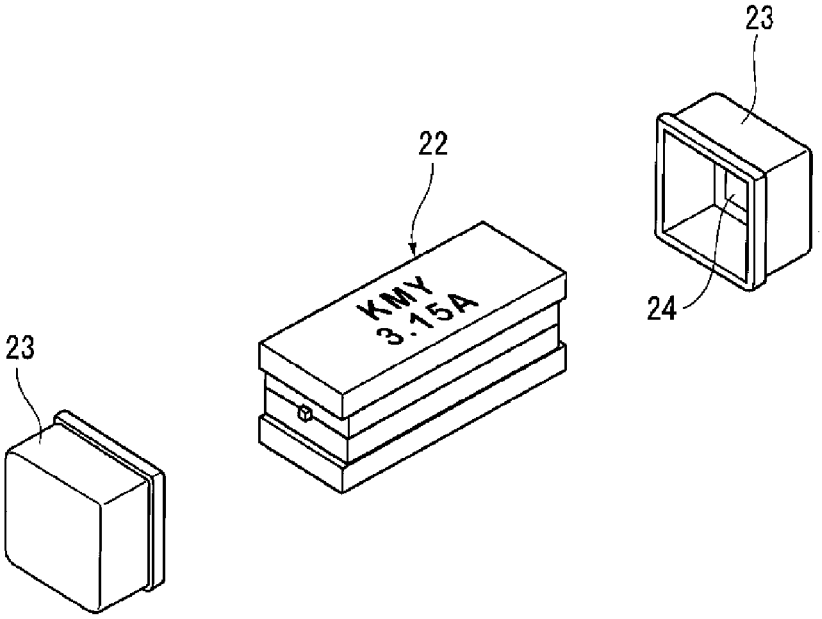
FIG. 8 is a perspective view illustrating the metal caps being fitted on the two ends of the fuse body shown in FIG. 7.
Figure 9:
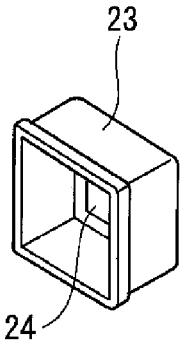
FIG. 9 is a perspective view of the metal cap to be fitted on each end of the fuse body in the above-discussed embodiment.
Figure 10:
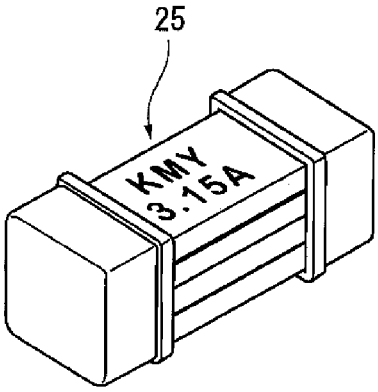
FIG. 10 is a perspective view of the completed chip fuse according to the embodiment.

FIG. 8 is a perspective view of the fuse body 22 of FIG. 7 before the metal cap 23 is fitted on each end. Referring to FIG. 8, the metal cap 23 produced by tin-copper-plating the structure as shown in FIG. 9 made of a copper-zinc alloy, is fitted on each end of the fuse body 22 in electrical conduction with the fuse wire 9 via solder cream 24. In this way, chip fuse 25 as shown in FIG. 10 is completed.

Figure 11:
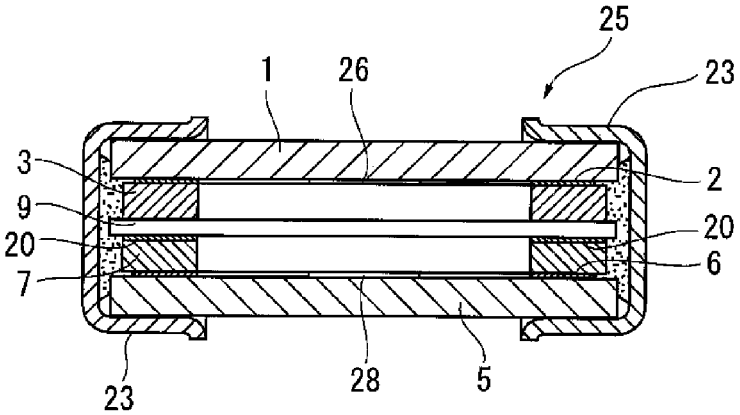
FIG. 11 is a longitudinal sectional view of the chip fuse according to the embodiment.
Figure 12:
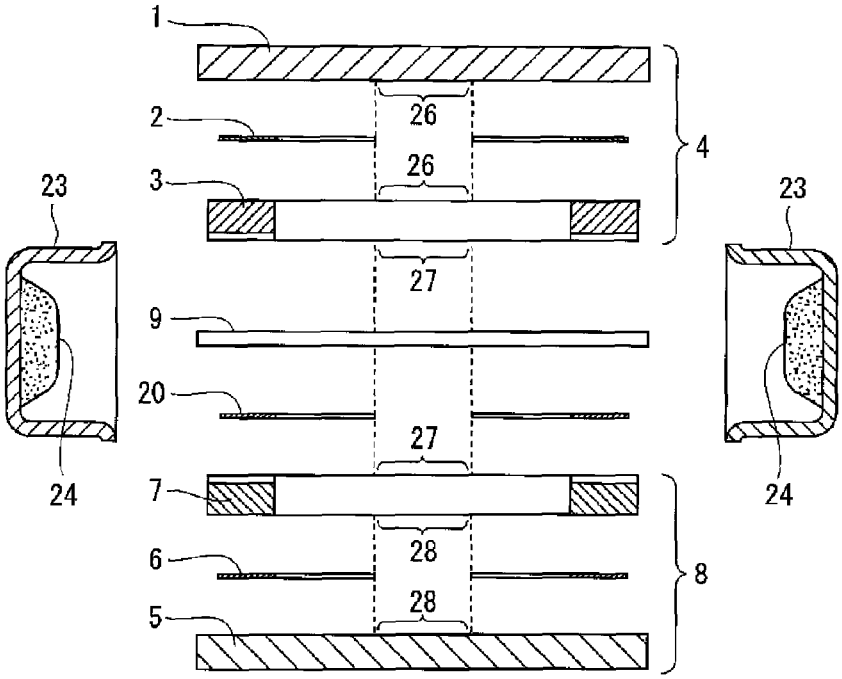
FIG. 12 is an exploded sectional view of the chip fuse according to the embodiment shown in the same section as in FIG. 11.

FIG. 11 is a longitudinal sectional view of the chip fuse 25 according to the present embodiment, and FIG. 12 shows the chip fuse 25 exploded and in the same section as in FIG. 11. As shown in these figures, the chip fuse 25 according to the present embodiment has a four-layer structure. With the non-adhered regions 26, 27, 28 partially left on the adhered surfaces among the four layers, three layers of the non-adhered regions are formed in the two side faces of the fuse body 22 with respect to its longitudinal.

According to the present embodiment, which has the structure as discussed above, the impact (pressure) or vapor generated upon fusion of the fuse wire 9 by the flow of overcurrent through the chip fuse 25 is not only buffered by the volume of the through holes 16, but also released through the non-adhered regions 26, 27, 28 in the side faces, so that safe current interruption is achieved. In other words, according to the present embodiment, damage or deformation of the chip fuse body, which is observed in conventional chip fuses, does not occur. Further, the releasing of the vapor generated upon fusion to outside remarkably improves the insulating resistance between the fused fuse terminals or between the fused fuse wire ends. The release of vapor through the non-adhered regions 26, 27, 28 may be adjusted by varying the shape and size of the adhesives 2, 6, 20.

The present embodiment is fabricated by vertically arranging a pair of fuse support halves each prepared by adhering together a ceramic substrate and a fuse wire support, holding a fuse wire between the pair of the fuse support halves and uniting the same to obtain a fuse body, and then covering the ends of the fuse body with metal caps, and accordingly the current interruption characteristics of the fuse as well as the insulating resistance between the fused fuse terminals or between the fused fuse wire ends after fusion may be improved.

In the production method discussed above, the upper ceramic substrate 1 and the upper fuse wire support half 3 are adhered to obtain the upper fuse support half 4, and the lower ceramic substrate 5 and the lower fuse wire support half 7 are adhered to obtain the lower fuse support half 8, and then the fuse wire 9 is held between the fuse support halves 4 and 8. Alternatively, the fuse wire 9 may be held between the upper fuse wire support half 3 and the lower fuse wire support half 7, and then the upper fuse wire support half 3 and the lower fuse wire support half 7 may be adhered to the upper ceramic substrate 1 and the lower ceramic substrate, respectively.

Figure 13:
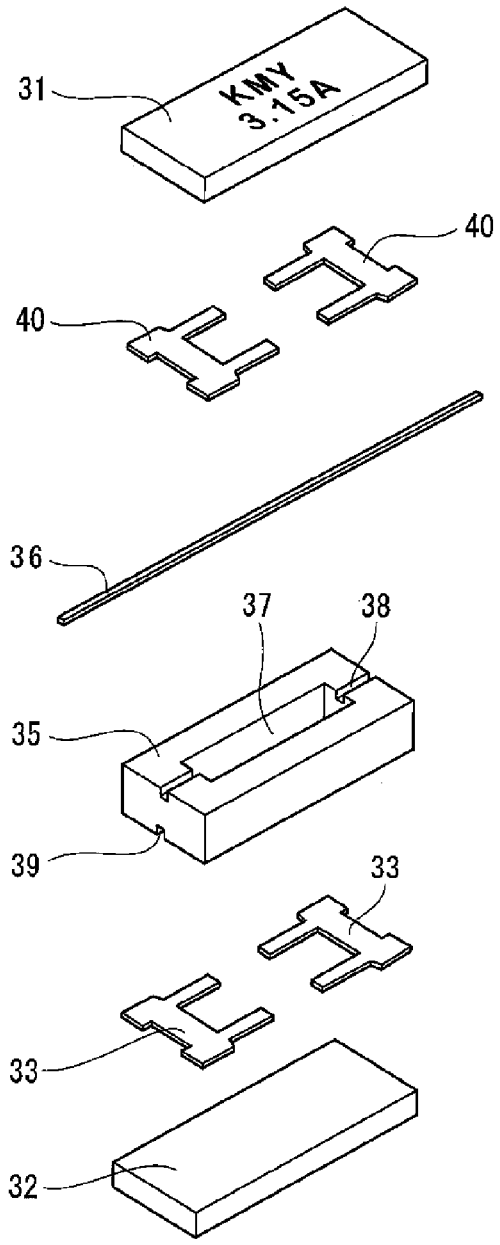
FIG. 13 is an exploded perspective view of the fuse body of the chip fuse according to a second embodiment of the present invention.

FIG. 13 is a perspective view of a fuse body of a chip fuse in explosion according to a second embodiment of the present invention. This fuse body is of a three-layer structure including upper ceramic substrate 31 arranged at the top, lower ceramic substrate 32 arranged at the bottom, and fuse wire support 35 adhered on the upper surface of the lower ceramic substrate 32 with adhesives 33. Fuse wire 36 is held between the fuse wire support 35 and the upper ceramic substrate 31.

This embodiment is the same as the first embodiment in that the upper ceramic substrate 31 and the lower ceramic substrate 32 are in the form of a thin flat plate, and the ceramic substrate 31, 32 is cut out, after various processing, of a ceramic sheet having a larger area than that. Production of the fuse wire support 35 is similar to that for the first embodiment, and through hole 37 is formed. In this embodiment, the fuse wire support grooves are formed in the upper and lower surfaces of the fuse wire support 35, wherein those formed in the upper surface of the fuse wire support 35 are fuse wire support grooves 38, whereas those formed in the lower surface are fuse wire support grooves 39. The structure, material, and characteristics of the fuse wire 36, and the materials of the adhesives 33, 40 are the same as those in the first embodiment. Also similarly to the first embodiment, the adhesives 33, 40 are formed in the predetermined shape, and accordingly non-adhered regions 44, 45 are partially left on the adhered surfaces of the upper ceramic substrate 31, the fuse wire support 35, and the lower ceramic substrate 32. Further similarly to the first embodiment, non-adhered regions 44, 45 are formed on the respective adhered surfaces of the members 31 and 35, and of the members 35 and 32, on both sides of the through hole 37 with respect to its longitudinal, and each pair of the members adhered together are closely adhered as a whole, so that the through hole 37 defines an internal space and is kept hermetically closed in the normal state, i.e., before fusion.

Figure 14:
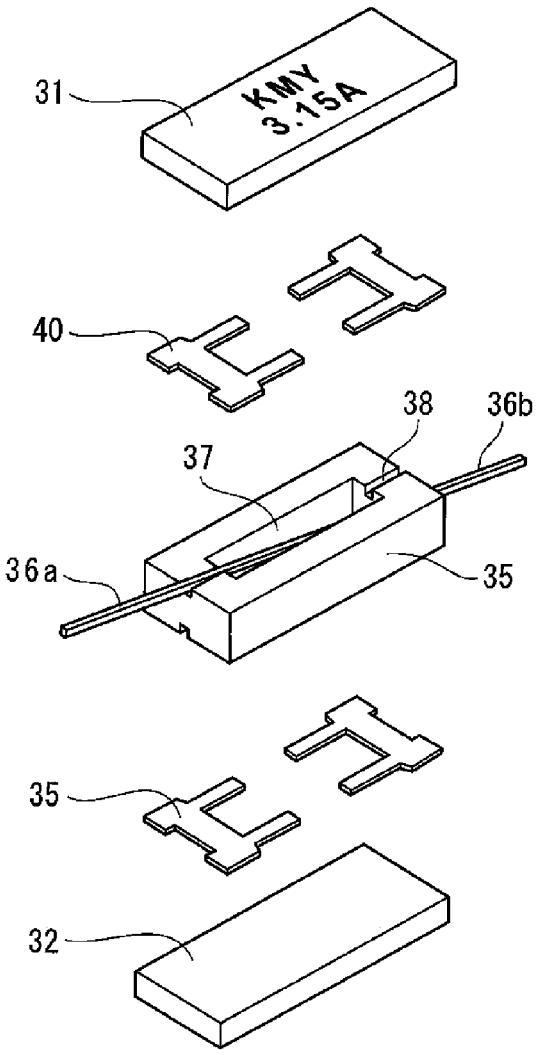
FIG. 14 is a perspective view showing the fuse wire arranged in the fuse wire support in the configuration of FIG. 13.

FIG. 14 is a perspective view illustrating that the fuse wire 36 is arranged with respect to the fuse wire support 35 from the state shown in FIG. 13. The fuse wire 36 is inserted into the through hole 37 in the fuse wire support 35, with one end 36*a* of the fuse wire arranged in the fuse wire support groove 38 formed in the upper surface of the fuse wire support 35 at one longitudinal end thereof, and the other end 36*b* of the fuse wire arranged in the fuse wire support groove 39 formed in the lower surface of the fuse wire support 35 at the other longitudinal end thereof.

Figure 15:
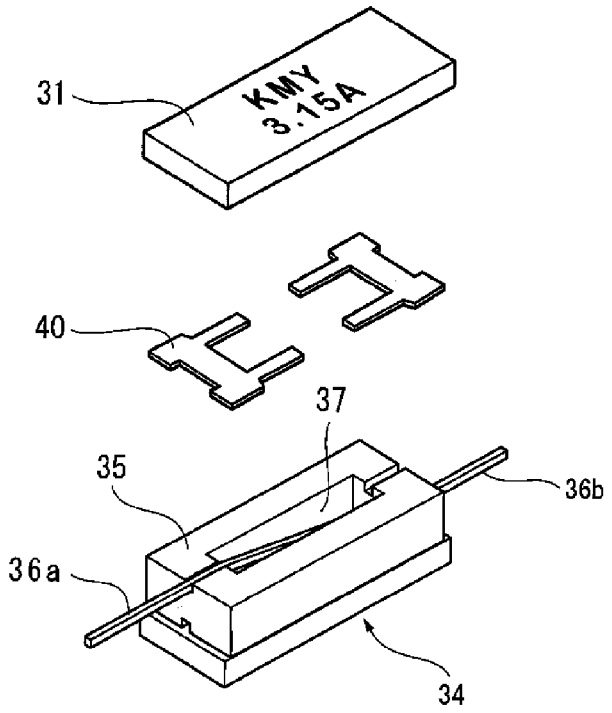
FIG. 15 is a perspective view showing the fuse wire support with the fuse wire adhered onto the upper surface of the lower ceramic substrate in the production process of the second embodiment.

FIG. 15 is a perspective view showing the fuse wire support 35 in which the fuse wire 36 is arranged as shown in FIG. 14, further adhered to the upper surface of the lower ceramic substrate 32 with adhesives 35. By adhering together the lower ceramic substrate 32 and the fuse wire support 35, the end 36*b* of the fuse wire 36 is fixed to the lower surface of the fuse wire support 35.

Figure 16:
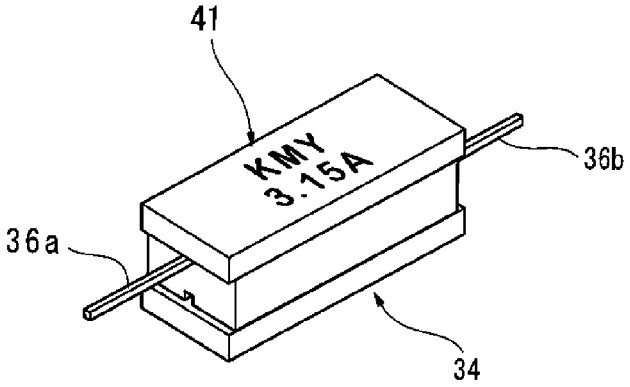
FIG. 16 is a perspective view of the upper ceramic substrate and the fuse wire support arranged and adhered thereon, in the production process of the embodiment.

FIG. 16 is a perspective view illustrating that the adhesives 40 are arranged on the upper surface of the fuse wire support 35 and, before the adhesives are cured, the upper ceramic substrate 31 is arranged on and adhered thereto. This is intermediate part 41 for a fuse body according to this embodiment. In this state of the intermediate part 41, the ends 36*a* and 36*b* of the fuse wire 36 are projecting from the end faces. The projecting portions are cut and removed, to obtain fuse body 42 as shown in FIG. 17.

Figure 17:
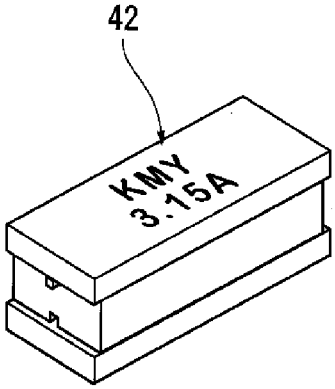
FIG. 17 is a perspective view of the fuse body fabricated through the steps shown in up to FIG. 16.
Figure 18:
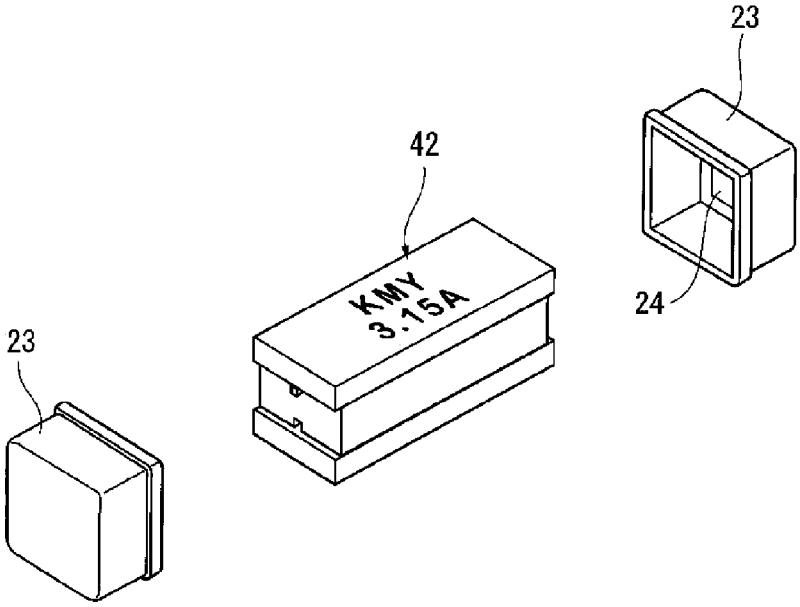
FIG. 18 is a perspective view illustrating the metal caps being fitted on the two ends of the fuse body shown in FIG. 17.
Figure 19:
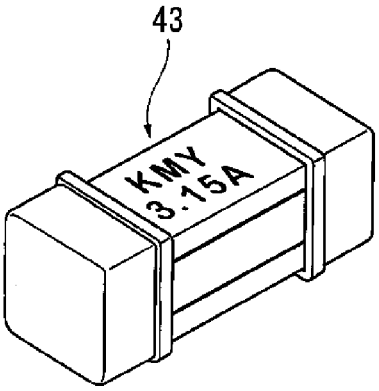
FIG. 19 is a perspective view of the completed chip fuse according to the embodiment.

FIG. 18 is a perspective view of the fuse body 42 of FIG. 17 before metal caps 23 are fitted on its ends. Referring to FIG. 18, the metal cap 23 of the structure as shown in FIG. 9 and made of, e.g., a tin-silver-copper alloy, is fitted on each end of the fuse body 42 in electrical conduction with the fuse wire 9 via solder cream 24, in the same way as in the first embodiment. In this way, chip fuse 43 as shown in FIG. 19 is completed.

Figure 20:
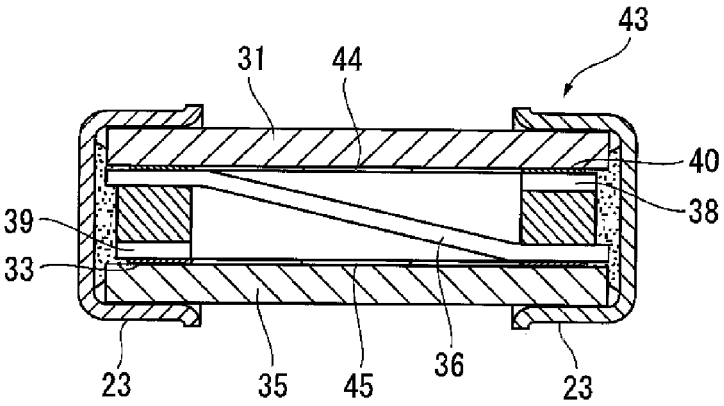
FIG. 20 is a longitudinal sectional view of the chip fuse according to the embodiment.
Figure 21:
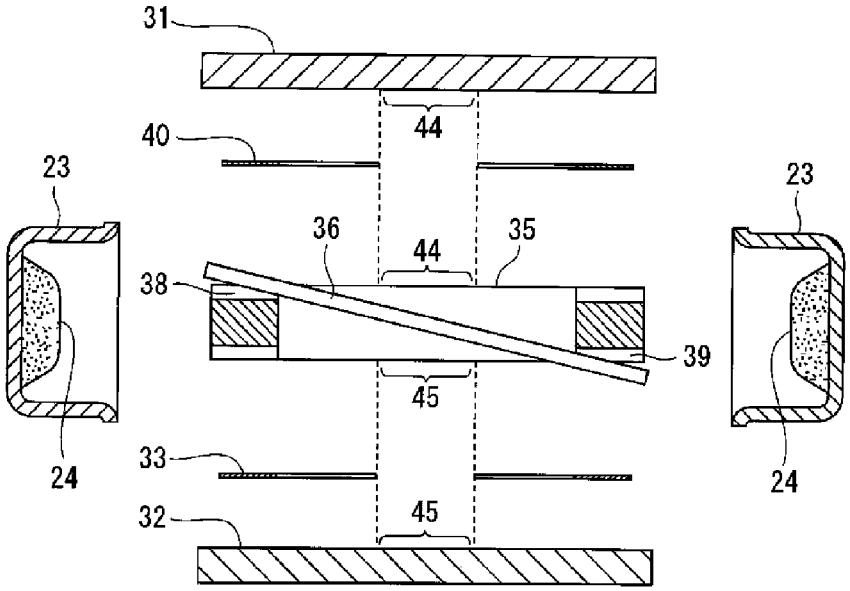
FIG. 21 is an exploded sectional view of the chip fuse according to the embodiment shown in the same section as in FIG. 20.

FIG. 20 is a longitudinal sectional view of the chip fuse 43 according to the present embodiment, and FIG. 21 shows the chip fuse 43, in explosion, and in the same section as in FIG. 20. As shown in these figures, the chip fuse 43 according to the present embodiment has a three-layer structure. With the non-adhered regions 26 partially left on the adhered surfaces of the three layers, two layers of the non-adhered regions are formed in the two side faces of the fuse body 42 with respect to its longitudinal.

According to this embodiment, which has the structure as discussed above, the impact (pressure) or vapor generated upon fusion of the fuse wire 9 by the flow of overcurrent through the chip fuse 43 is not only buffered by the volume of the through hole 37, but also released through the non-adhered regions 44, 45 in the side faces, so that safe current interruption is achieved. In other words, according to the present embodiment, damage or deformation of the chip fuse, which is observed in conventional chip fuses, does not occur. Further, the releasing of the vapor generated upon fusion to outside remarkably improves the insulating resistance between the fused fuse terminals or between the fused fuse wire ends. The release of vapor through the non-adhered regions 44, 45 may be adjusted by varying the shape and size of the adhesives 33, 40.

In the first and second embodiments discussed above, during the fabrication of the fuse body, the upper ceramic substrate and the fuse wire support, and the lower ceramic substrate and the fuse wire support, are respectively adhered together on their mutually facing surfaces to hermetically close the through hole(s), while the non-adhered regions are left partially on the adhered surfaces, so that the internal through hole is kept hermetically closed in the normal state. In another embodiment, during the fabrication of the fuse body, discharge holes for releasing the impact and vapor generated upon fusion may be formed between the upper ceramic substrate and the fuse wire support and between the lower ceramic substrate and the fuse wire support.

EXAMPLES

Example

Chip fuses of a four-layer structure according to the first embodiment of the present invention were fabricated. Upper and lower ceramic substrates and upper and lower fuse wire support halves were prepared from ceramic sheets. Using fuse wires prepared by silver-plating annealed copper wires, an epoxy adhesive, metal caps prepared by tin-copper-plating a copper-zinc alloy, and a solver cream, 0.011Ω chip fuses of Nos. 1 to 10 were obtained. Current interruption tests were conducted on the obtained chip fuses by applying alternating current of 100 V (phase angle 60°) at 100 A to fuse. The actually measured resistance and breaking time are shown in Table 1. Next, 500 V was applied to the fused chip fuses for 1 minute, and the residual resistance between the fuse terminals was measured with Digital Multi Meter (KIKUSUI ELECTRONICS CORP.). The results are shown in Table 1. In Table 1, "O.L." (over load) in the column of the residual resistance means that the residual resistance was beyond the measurable range of the Multi Meter (1200 MΩ).

TABLE 1

| Chip Fuse | Measured resistance (Ω) | Breaking time (ms) | Residual resistance (kΩ) |
|---|---|---|---|
| No. 1 | 0.011413 | 1.226 | O.L. |
| No. 2 | 0.011255 | 1.116 | O.L. |
| No. 3 | 0.011462 | 1.080 | O.L. |
| No. 4 | 0.011553 | 1.044 | O.L. |
| No. 5 | 0.011541 | 1.116 | O.L. |
| No. 6 | 0.011459 | 1.080 | O.L. |
| No. 7 | 0.011354 | 1.080 | O.L. |
| No. 8 | 0.011325 | 1.080 | O.L. |
| No. 9 | 0.011527 | 1.044 | O.L. |
| No. 10 | 0.011373 | 1.044 | O.L. |

The Electrical Appliance and Material Safety Law in Japan stipulates that the residual resistance after the short circuit breaking performance test should be not lower than 200 kΩ. Table 1 shows that the residual resistances of all of the chip fuses of Nos. 1 to 10 satisfied the standard of the Electrical Appliance and Material Safety Law in Japan. Further, in all of the chip fuses, the impact (pressure) or vapor generated upon breaking operation was released through the non-adhered regions in the side faces, which generated three gap layers of a slight width in the side faces of the chip fuses, but the fuse bodies were not damaged.

COMPARATIVE EXAMPLE

Chip fuses were produced according to the prior art disclosed in JP-2012-174443-A. Similarly to the Example discussed above, a fuse wire support provided with a central through hole and fuse wire support grooves was prepared, the same epoxy adhesive as in the Example was applied to the fuse wire support grooves of the support, and the same fuse wire as in the Example was mounted linearly between the opposing ends of the fuse wire support across the through hole, to thereby obtain a fuse assembly. This fuse assembly was inserted into an alumina ceramic casing in the form of a rectangular cylinder, and metal caps were fixed on both ends with a solder cream in the same way as in the Example, so that 0.011Ω chip fuses of Nos. 1 to 5 were obtained. The current interruption tests were conducted on the obtained chip fuses and the residual resistances after fusion were measured in the same way as in the Example. The results are shown in Table 2.

TABLE 2

| Chip Fuse | Measured resistance (Ω) | Breaking time (ms) | Residual resistance (kΩ) |
|---|---|---|---|
| No. 1 | 0.010976 | 1.020 | 568.12 |
| No. 2 | 0.010979 | 1.093 | 102.38 |
| No. 3 | 0.011109 | 1.056 | 22.47 |
| No. 4 | 0.010812 | 1.020 | 110.47 |
| No. 5 | 0.011541 | 1.093 | 30.16 |

Table 2 shows that the residual resistances of all the chip fuses of Nos. 1 to 5 in the Comparative Example were lower than those of the chip fuses in the Example. The standard of the Electrical Appliance and Material Safety Law in Japan was satisfied only by the chip fuse of No. 1, and the residual resistances of the chip fuses of Nos. 2 to 5 were beyond the standard. In all the chip fuses, the surface was observed to have been burned by the impact (pressure) or vapor generated upon breaking operation.

DESCRIPTION OF REFERENCE SIGNS

1, 31: upper ceramic substrate
2, 6, 20, 33, 40: adhesive
3: upper fuse wire support half
4: upper fuse support half
5, 32: lower ceramic substrate
7: lower fuse wire support half
8: lower fuse support half
9, 36: fuse wire
16, 37: through hole
17, 38, 39: fuse wire support groove
22, 42: fuse body
23: metal cap
25, 43: chip fuse
26, 27, 28, 44, 45: non-adhered region
35: fuse wire support.

What is claimed is:

1. A chip fuse comprising a fuse body and a pair of metal caps, said fuse body further comprising:

a pair of vertically facing upper and lower ceramic substrates, a fuse wire support having a vertical through hole in its center and held between said upper and lower ceramic substrates, and a fuse wire mounted between two ends of said fuse wire support across the through hole, wherein said metal caps are fitted on two ends of said fuse body in electrical conduction with said fuse wire extending out of two ends of said fuse wire support, wherein mutually facing surfaces of said upper ceramic substrate and said fuse wire support, and of said lower ceramic substrate and said fuse wire support, respectively, are flat and have an adhered region that is adhered together with an adhesive and a non-adhered region that is not adhered together, so that said through hole is closed with said upper and lower ceramic substrates and said fuse wire support, wherein said non-adhered region is formed in a side face of the fuse body with respect to its longitudinal axis, whereby impact and vapor generated upon fusion of said fuse wire is released from inside the chip fuse through the non-adhered region to outside.

2. The chip fuse according to claim 1, wherein said non-adhered region is formed on both sides of the through hole with respect to its longitudinal axis.

3. The chip fuse according to claim 1, wherein said fuse wire support is composed of an upper fuse wire support half and a lower fuse wire support half vertically arranged with respect to each other, wherein said through hole vertically penetrates the upper fuse wire support half and the lower fuse wire support half, and wherein said fuse wire is mounted across the through hole in the longitudinal direction of the fuse wire support.

4. The chip fuse according to claim 3, wherein said non-adhered region is formed between the upper ceramic substrate and the upper fuse wire support half, between the upper fuse wire support half and the lower fuse wire support half, and between the lower fuse wire support half and the lower ceramic substrate.

5. The chip fuse according to claim 1, wherein said fuse wire support is a single body, and said fuse wire is mounted across the through hole in the fuse wire support at a slant between two opposed ends of the fuse wire support from an upper surface at one of the ends to a lower surface at the other of the ends of the fuse wire support.

6. A method for producing the chip fuse of claim 1, comprising:

mounting a fuse wire between two ends of a fuse wire support having a vertical through hole in its center, across said through hole, holding said fuse wire support with the fuse wire between a pair of upper and lower vertically facing ceramic substrates, adhering together said pair of the ceramic substrates and said fuse wire support on their mutually facing surfaces, which are flat, partially leaving a non-adhered region on said surfaces so that the mutually facing surfaces have an adhered region that is adhered together with an adhesive and a non-adhered region that is not adhered together, to thereby form a fuse body, wherein said non-adhered region is formed in a side face of the fuse body with respect to its longitudinal axis, and fitting a metal cap on each end of said fuse body in electrical conduction with said fuse wire.

7. The method according to claim 6, wherein said non-adhered region is formed on both sides of said through hole with respect to its longitudinal axis.

8. The method according to claim 6, wherein said fuse wire support is composed of an upper fuse wire support half and a lower fuse wire support half vertically arranged with respect to each other, wherein said through hole vertically penetrates the upper fuse wire support half and the lower fuse wire support half, and wherein said fuse wire is mounted across the through hole in the longitudinal direction of the fuse wire support between the upper fuse wire support half and the lower fuse wire support half.

9. The method according to claim 8, wherein said non-adhered region is formed between the upper ceramic substrate and the upper fuse wire support half, between the upper fuse wire support half and the lower fuse wire support half, and between the lower fuse wire support half and the lower ceramic substrate.

10. The method according to claim 6, wherein said fuse wire support is a single body, and said fuse wire is mounted across the through hole in the fuse wire support at a slant between two opposed ends of the fuse wire support from an upper surface at one of the ends to a lower surface at the other of the ends of the fuse wire support.

11. A method for producing the chip fuse of claim 3, comprising:

adhering together an upper ceramic substrate and an upper fuse wire support half having a vertical through hole in its center, and a lower ceramic substrate and a lower fuse wire support half having a vertical through hole in its center, respectively, on their mutually facing surfaces, partially leaving a non-adhered region on said surfaces so that the mutually facing surfaces have an adhered region that is adhered together with an adhesive and a non-adhered region that is not adhered together, mounting a fuse wire between two ends of said lower fuse wire support half across said through hole, arranging vertically with respect to each other and adhering together said lower fuse wire support half with the fuse wire and said upper fuse wire support half on their mutually facing surfaces, which are flat, partially leaving a non-adhered region on said surfaces so that the mutually facing surfaces have an adhered region that is adhered together with an adhesive and a non-adhered region that is not adhered together, to thereby form a fuse body, wherein said non-adhered region is formed in a side face of the fuse body with respect to its longitudinal axis, and fitting a metal cap on each end of said fuse body in electrical conduction with said fuse wire.

12. The method according to claim 11, wherein said non-adhered region is formed on both sides of the through hole with respect to its longitudinal axis.

* * * * *